US010081200B2

(12) United States Patent
Mori

(10) Patent No.: US 10,081,200 B2
(45) Date of Patent: Sep. 25, 2018

(54) RECORDING APPARATUS HAVING SUPPORT SECTION WITH A DISCARDING SECTION

(71) Applicant: SEIKO EPSON CORPORATION, Tokyo (JP)

(72) Inventor: Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/460,052

(22) Filed: Mar. 15, 2017

(65) Prior Publication Data

US 2017/0266966 A1 Sep. 21, 2017

(30) Foreign Application Priority Data

Mar. 18, 2016 (JP) ..... 2016-054953

(51) Int. Cl.
*B41J 11/06* (2006.01)
*B41J 2/155* (2006.01)

(52) U.S. Cl.
CPC ..... *B41J 11/06* (2013.01); *B41J 2/155* (2013.01); *B41J 2202/20* (2013.01)

(58) Field of Classification Search
CPC ..... B41J 2/1433; B41J 2/16517
See application file for complete search history.

(56) References Cited

U.S. PATENT DOCUMENTS

2003/0030692 A1* 2/2003 Uchida ..... B41J 2/1721 347/35
2003/0227514 A1* 12/2003 Nakashima ..... B41J 2/16585 347/42
2005/0093919 A1* 5/2005 Takatsuka ..... B41J 2/16523 347/30
2017/0266975 A1 9/2017 Mori

FOREIGN PATENT DOCUMENTS

JP 2001-071521 3/2001
JP 2004-009667 1/2004
JP 2017165056 A 9/2017

* cited by examiner

*Primary Examiner* — Bradley Thies
(74) *Attorney, Agent, or Firm* — Workman Nydegger

(57) ABSTRACT

A recording apparatus includes a recording head on which a plurality of nozzle rows are arranged in a width direction that intersects with a transfer direction; and a support section which includes a discarding section which includes a position which faces the nozzle rows and allows ink ejected by the recording head to pass therethrough, and a support surface which is disposed at a position which does not face the nozzle rows and is configured to support the paper sheet, wherein the support surface includes a first support surface which is disposed in a region which faces gaps between the nozzle rows in the width direction and a second support surface which extends in a region longer than a region in which the first support surface is disposed in the width direction, and the first support surface and the second support surface are formed to be flush with each other.

8 Claims, 9 Drawing Sheets

RECORDING APPARATUS HAVING SUPPORT SECTION WITH A DISCARDING SECTION

CROSS REFERENCES TO RELATED APPLICATIONS

The entire disclosure of Japanese Patent Application No. 2016-054953, filed Mar. 18, 2016 is expressly incorporated by reference herein.

BACKGROUND

1. Technical Field

The present invention relates to recording apparatuses such as ink jet printers.

2. Related Art

Ink jet printers have been known as a type of recording apparatuses. The ink jet printers include a head which is fixedly disposed at a position which faces a support section that supports a paper sheet, which is an example of a medium, and performs printing on the paper sheet transported on the support section by ejecting ink, which is an example of liquid, from a plurality of nozzles disposed on the head. In such printers, so-called flushing, which is an operation of discharging ink in the nozzles as appropriate, needs to be performed in order to maintain and recover ejection properties of ink in the nozzles of the head. JP-A-2004-9667 describes a printer which includes a support section which faces a head having a plurality of nozzle groups composed of a plurality of nozzles, and is configured to support a paper sheet by a plurality of protrusions disposed at positions which face gaps between the plurality of nozzle groups disposed on the head. The printer performs flushing by ejecting ink onto a region of the support section which faces the nozzle groups of the head, that is, a region between the protrusions on the support section.

In the case of the printer described in JP-A-2004-9667, the support section supports the paper sheet only by the portions (protrusions) which face gaps between the nozzle groups disposed on the head. Consequently, there is a risk that the paper sheet transported on the support section is not retained in a constant position. If the paper sheet is slanted or curved on the support section, ink ejected from the nozzles of the head is attached on a deviated position on the paper sheet, which may affect quality of recording.

SUMMARY

An advantage of some aspects of the invention is that a recording apparatus that can achieve flatness of a medium supported by a support section which can be flushed by a recording head that ejects liquid is provided.

The following describes means for solving the above problem and the advantageous effect thereof. According to an aspect of the invention, a recording apparatus for solving the above problem includes a support section that supports a medium which is transported; and a recording head which is fixedly disposed at a position which faces the support section, and performs recording by using liquid on the medium supported by the support section, wherein the recording head includes a plurality of nozzle rows which are composed of a plurality of nozzles that eject the liquid, the plurality of nozzle rows is arranged in a width direction that intersects with a transfer direction of the medium in the recording head, the support section includes a discarding section which includes a position which faces the nozzle rows of the recording head and allows the liquid ejected from the nozzle rows during flushing performed by the recording head to pass therethrough, and a support surface which is disposed at a position which does not face the nozzle rows of the recording head and is configured to support the medium, and the support surface includes a first support surface which is disposed in a region which faces gaps between the nozzle rows of the recording head, and a second support surface which extends in a region longer than a region in which the first support surface is disposed in the width direction, and the first support surface and the second support surface are formed to be flush with each other.

With this configuration, the support section can support the medium by the second support surface that extends in a region longer than the first support surface in the width direction that intersects with the transfer direction of the medium as well as the first support surface disposed in a region which faces gaps between the nozzle rows of the recording head. That is, compared with a configuration in which the medium is supported solely by the portion which faces gaps between the nozzle rows of the recording head (first support surface), the support section is in contact with the medium in an increased contact area. Accordingly, flatness of the medium supported by the support section which can be flushed by the recording head that ejects ink can be achieved.

In the above recording apparatus, it is preferable that the second support surface is disposed on the support surface at least in an upstream region in the transfer direction with respect to a region which faces the nozzle rows.

With this configuration, flatness of the medium before recording is performed can be achieved. In the above recording apparatus, it is preferable that the second support surface is also disposed on the support surface in a downstream region in the transfer direction with respect to a region which faces the nozzle rows.

With this configuration, flatness of the medium after recording is performed can also be achieved. In the above recording apparatus, it is preferable that the second support surfaces each disposed in the upstream and downstream regions in the transfer direction with respect to a region which faces the nozzle rows are connected to each other in regions on both ends in the width direction.

With this configuration, flatness of the medium supported by the support section can be more reliably achieved. In the above recording apparatus, the second support surfaces each disposed in the upstream and downstream regions in the transfer direction with respect to a region which faces the nozzle rows are connected to each other in a region inside both ends in the width direction.

With this configuration, flatness of the medium supported by the support section can be more reliably achieved. In the above recording apparatus, it is preferable that the discarding section includes an inclined surface which is upwardly inclined toward a downstream side in the transfer direction.

With this configuration, a risk that the end of the medium transported on the support section is caught by the discarding section can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an ink jet printer, which is a type of a recording apparatus, that performs recording on a medium by using ink, which is an example of a liquid, will be described.

First Embodiment

Figure 1:
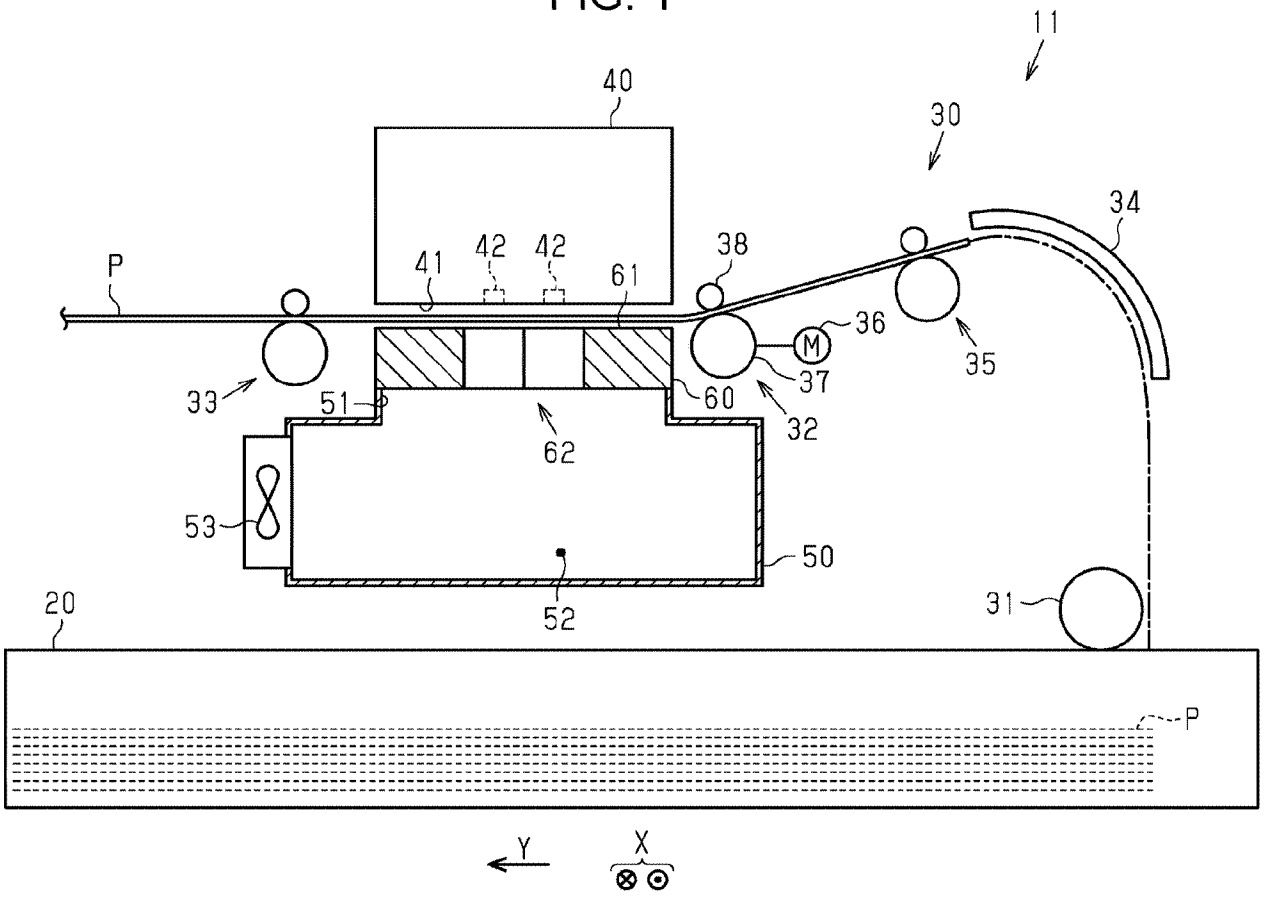
FIG. 1 is a schematic side view of a recording apparatus according to a first embodiment.

As shown in FIG. 1, a recording apparatus 11 according to a first embodiment includes a paper sheet cassette 20 that is configured to house paper sheets P, which are examples of a medium, in a stacked state, a transferring unit 30 that transports the paper sheet P housed in the paper sheet cassette 20, a support section 60 that supports the paper sheet P from the underside while the paper sheet P is transported to the transferring unit 30, and a recording head 40 that performs recording on the paper sheet P supported by the support section 60. In the following description, a direction in which the paper sheet P is transported on the support section 60 (that is, a direction from the right to the left in FIG. 1) is defined as a transfer direction Y of the paper sheet P, and a direction which is perpendicular to the transfer direction Y is defined as a width direction X of the paper sheet P.

The transferring unit 30 includes a pick-up roller 31 that sequentially feeds out the uppermost paper sheet P in the paper sheet cassette 20, a transportation roller pair 32 that transports the paper sheet P fed out by the pick-up roller 31 toward the support section 60, and an output roller pair 33 that outputs the paper sheet P which has passed on the support section 60. That is, the transportation roller pair 32 is disposed upstream to the support section 60 in the transfer direction Y, and the output roller pair 33 is disposed downstream to the support section 60. Further, the transferring unit 30 includes a guide section 34 and a relay roller pair 35 disposed between the pick-up roller 31 and the transportation roller pair 32 in a transportation path (a path indicated by the alternate long and short dashed line in FIG. 1) in which the paper sheet P is transported. That is, the guide section 34 guides the paper sheet P fed out by the pick-up roller 31 toward the relay roller pair 35, and the relay roller pair 35 transports the paper sheet P guided by the guide section 34 toward the transportation roller pair 32.

The transportation roller pair 32 that transports the paper sheet P includes a driving roller 37 which rotates about an axis which extends in the width direction X by driving of a motor 36, and a driven roller 38 which also rotates about an axis which extends in the width direction X by rotation of the driving roller 37. In transportation of the paper sheet P, the driving roller 37 comes into contact with the paper sheet P from the underside, and the driven roller 38 comes into contact with the paper sheet P from the above. That is, the transportation roller pair 32 transports the paper sheet P by rotation of the driving roller 37 and the driven roller 38 which nip the paper sheet P therebetween from the upper and lower sides. The output roller pair 33 and the relay roller pair 35 have the same configuration.

The support section 60 has a plate shape, and the top surface of the support section 60 that faces the recording head 40 is a support surface 61 which supports the paper sheet P when coming into contact with the paper sheet P. Further, the support section 60 includes a discarding section 62 which allows ink ejected from the recording head 40 to pass therethrough. Under the support section 60, a container 50 that stores ink which passes through the discarding section 62 is provided. The container 50 has an opening port 51 on an upper side that communicates with the discarding section 62 of the support section 60, and a storing chamber 52 that is configured to store the ink which passes through the opening port 51. The storing chamber 52 includes an ink absorber (not shown in the figure) such as sponge. The container 50 further includes a fan 53 for taking ink droplets or the like suspended in air into the storing chamber 52 through the opening port 51. Further, the fan 53 allows for stabilized transportation of the paper sheet P by suctioning the paper sheet P through the discarding section 62 while the paper sheet P is transported on the support section 60.

The recording head 40 is fixedly disposed at a position above the support section 60 and facing the support section 60. Further, the recording head 40 includes a plurality of nozzles 42 disposed on the underside, that is, an ejection surface 41, so as to eject ink from the nozzles 42 to thereby perform recording on the paper sheet P. The recording head 40 is formed of a so-called line head, which is an elongated head that can eject ink across the width direction X of the paper sheet P at a substantially simultaneous timing. The recording head 40 according to the present embodiment performs so-called flushing, that is, an operation of forcibly ejecting ink from the nozzles 42 as appropriate in order to prevent ink in the nozzle 42 from increasing in viscosity or solidifying. By virtue of this flushing, ejection properties of ink in the recording head 40 can be maintained and recovered. That is, the discarding section 62 disposed in the support section 60 allows the ink ejected from the nozzles 42 of the recording head 40 by flushing to pass through the support section 60 from the recording head 40 to the container 50.

Figure 2:
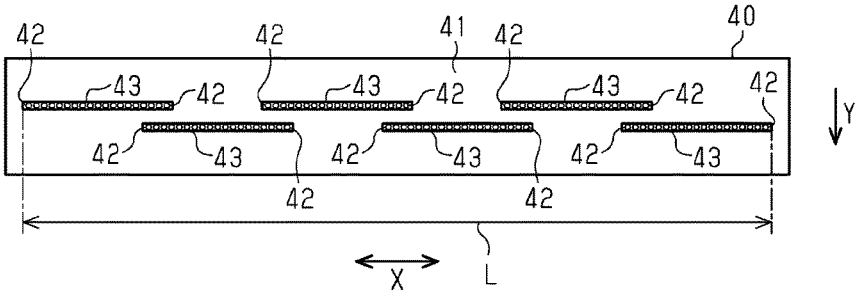
FIG. 2 is a bottom view of a recording head, which shows a nozzle array.

As shown in FIG. 2, on the ejection surface 41 of the recording head 40, a plurality of nozzle rows 43 composed of the plurality of nozzles 42 is provided. The respective nozzle rows 43 are composed of the plurality of nozzles 42 arranged in the width direction X, and are positioned so as to be parallel to each other on the ejection surface 41. Further, the nozzle rows 43 are arranged in two rows in the transfer direction Y with a predetermined space interposed in the width direction X. That is, the nozzle rows 43 disposed on the ejection surface 41 of the recording head 40 are arranged in a zig-zag pattern extending in the width direction X. Further, the nozzle rows 43 adjacent in the width direction X are overlapped each other as seen in the transfer direction Y on the ejection surface 41. That is, the nozzles 42 seem to be continuously arranged in the width direction X without a gap as seen in the transfer direction Y on the ejection surface 41. In the present embodiment, the plurality of nozzles 42, which are arranged in the width direction X, extends across a length L.

Figure 3:
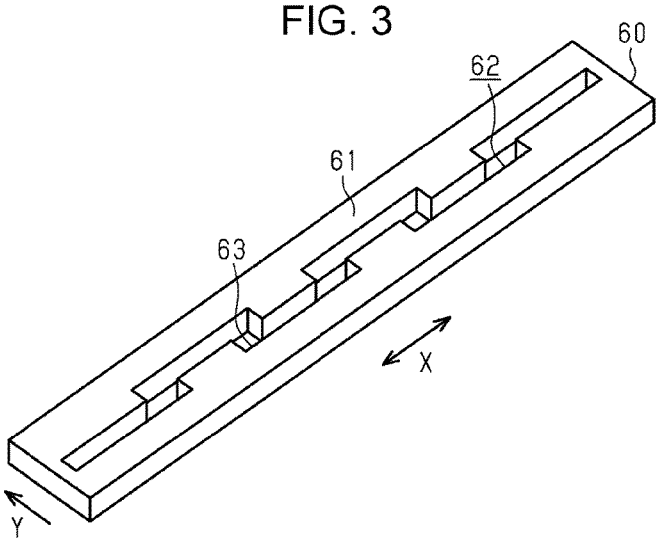
FIG. 3 is a perspective view of a support section.
Figure 4:
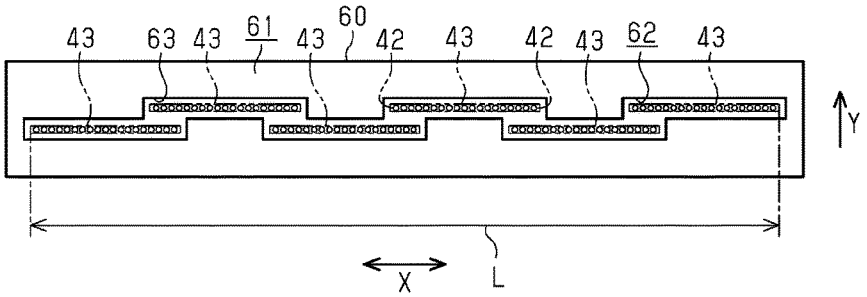
FIG. 4 is a plan view of the support section, which shows a positional relation between a discarding section and a nozzle row.

As shown in FIGS. 3 and 4, the support section 60 is formed in an elongated shape extending in the width direction X of the paper sheet P. The discarding section 62 provided in the support section 60 is disposed so as to face the nozzle rows 43 of the recording head 40. The discarding section 62 according to the present embodiment continuously extends at positions corresponding to the respective nozzle rows 43 as a single through hole 63 that vertically penetrates the support section 60. That is, the discarding section 62 is disposed in a center area of the support section 60 in the transfer direction Y in a zig zag pattern extending in the width direction X corresponding to the array of the nozzle rows 43 disposed on the ejection surface 41 of the recording head 40. Then, ink ejected from the nozzles 42 by flushing is stored in the container 50 through the through hole 63. Further, the support surface 61 that supports the paper sheet P is provided on the top of the support section 60 in an area where the discarding section 62 is not disposed, that is, a position which does not face the nozzle rows 43 of the recording head 40.

Figure 5:
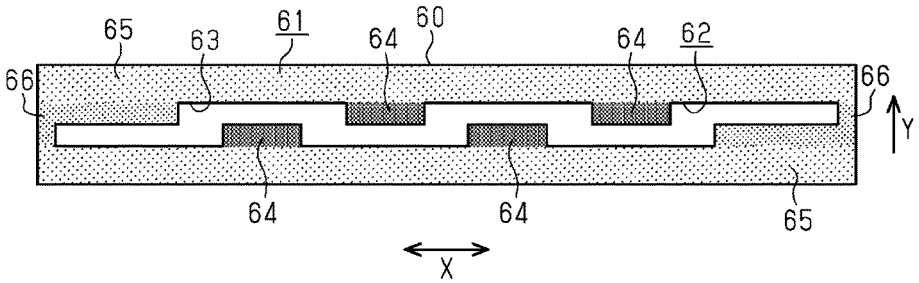
FIG. 5 is a plan view of the support section.

As shown in FIGS. 4 and 5, the support surface 61 is composed of first support surfaces 64 disposed at regions which face gaps between the nozzle rows 43 which are adjacent in the width direction X, second support surfaces 65 that extend in regions longer than the regions of the first support surfaces 64 in the width direction X, and third support surfaces 66 disposed in regions on both ends in the width direction X. The second support surfaces 65 according to the present embodiment are disposed on the support surface 61 in the upstream and downstream regions in the transfer direction Y with respect to the region that faces the nozzle rows 43. Further, the second support surface 65 extends longer than the length L which is the total width of the nozzles 42 in the width direction X.

Each of the second support surfaces 65 disposed on the upstream side and downstream side in the transfer direction Y are connected to each other via the third support surfaces 66 disposed in the regions on both ends in the width direction X. That is, the second support surfaces 65 and the third support surfaces 66 are disposed so as to surround the through hole 63 which opens to the top of the support section 60. Moreover, the first support surfaces 64 are disposed at four positions which face the gaps between the nozzle rows 43 of the recording head 40, and are connected to each other via the second support surfaces 65 in the transfer direction Y. The first support surfaces 64, the second support surfaces 65, and the third support surfaces 66 are provided to be flush with each other.

Then, effects of the recording apparatus 11 according to the first embodiment having the above configuration will be described. As shown in FIGS. 4 and 5, the support section 60 according to the first embodiment is provided with the discarding section 62 at a position which faces the nozzle rows 43 of the recording head 40, and the support surface 61 that supports the paper sheet P at a position other than the discarding section 62. That is, of the support surface 61, the second support surfaces 65 that extend in regions longer than the regions of the first support surfaces 64 in the width direction X as well as the first support surfaces 64 disposed at regions which face gaps between the nozzle rows 43 which are adjacent in the width direction X contribute to supporting the paper sheet P on which recording is performed by the recording head 40. Further, in the present embodiment, the third support surfaces 66 disposed in regions on both ends in the width direction X also contribute to supporting the paper sheet P. That is, since the support section 60 supports the paper sheet P by the second support surfaces 65 and the third support surfaces 66 as well as the first support surfaces 64, the paper sheet P transported on the support section 60 can be easily retained in a constant position. In other words, flatness of the paper sheet P can be easily achieved by increasing the regions of the support surface 61 that supports the paper sheet P.

According to the above first embodiment, the following advantageous effects can be obtained.

(1) The support section 60 can support the paper sheet P by the second support surfaces 65 that extend in regions longer than the regions of the first support surfaces 64 in the width direction X that intersects with the transfer direction Y of the paper sheet P as well as the first support surfaces 64 disposed at regions which face gaps between the nozzle rows 43 which are adjacent in the width direction X. That is, compared with a configuration in which the paper sheet P is supported solely by the portions which face the gaps between the nozzle rows 43 of the recording head 40 (first support surfaces 64), the support section 60 is in contact with the paper sheet P in an increased contact area. Accordingly, flatness of the paper sheet P supported by the support section 60 which can be flushed by the recording head 40 that ejects ink can be achieved.

(2) Flatness of the paper sheet P before recording is performed can be achieved since the second support surface 65 is disposed on the support surface 61 at least in the upstream region in the transfer direction Y with respect to the region which faces the nozzle rows 43.

(3) Flatness of the paper sheet P after recording is performed can also be achieved since the second support surface 65 is disposed on the support surface 61 in the downstream region in the transfer direction Y with respect to the region which faces the nozzle rows 43.

(4) Flatness of the paper sheet P supported by the support section 60 can be more reliably achieved since the second support surfaces 65 disposed on the support surface 61 in the upstream and downstream regions in the transfer direction Y are connected to each other via the third support surfaces 66 disposed in regions on both ends in the width direction X.

Second Embodiment

Next, a second embodiment of the recording apparatus 11 will be described. The recording apparatus 11 according to the second embodiment is different from the first embodiment in the configuration of the support section 60 that supports the paper sheet P, and the same as the first embodiment in the remaining configuration. Accordingly, the description of the same configuration is omitted.

Figure 6:
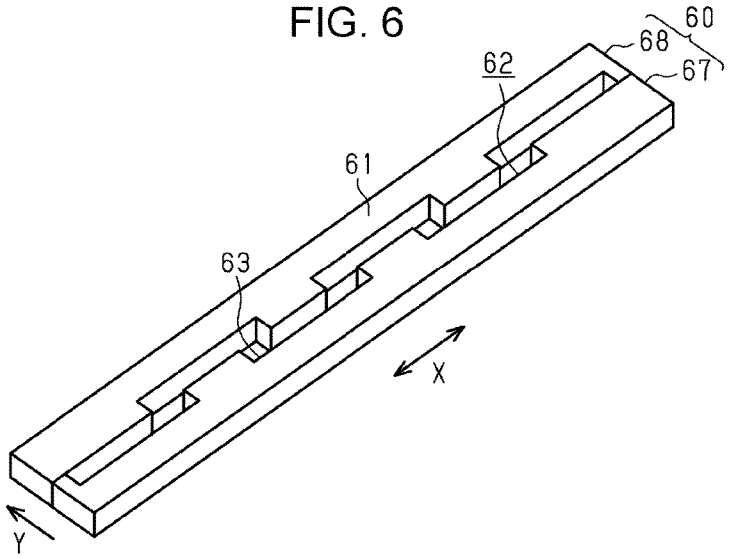
FIG. 6 is a perspective view of a support section of a recording apparatus according to a second embodiment.
Figure 7:
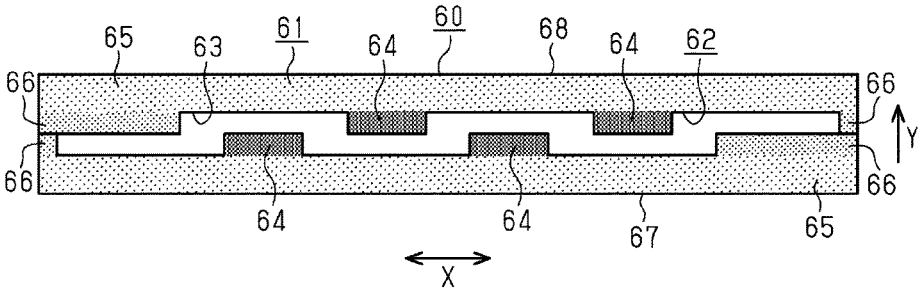
FIG. 7 is a plan view of the support section according to the second embodiment.

As shown in FIGS. 6 and 7, the support section 60 according to the second embodiment is composed of an upstream side support section 67 that forms an upstream portion of the support section 60 in the transfer direction Y and a downstream side support section 68 that forms a downstream portion of the support section 60. That is, the support section 60 is composed of the separately formed upstream side support section 67 and the downstream side support section 68, which are connected to each other in the transfer direction Y. The upstream side support section 67 and the downstream side support section 68 each include the first support surfaces 64, the second support surface 65 and the third support surfaces 66. The upstream side support section 67 and the downstream side support section 68 form the support section 60 when the third support surfaces 66 which are disposed on both ends in the width direction X are connected so as to be flush with each other.

According to the second embodiment, the advantageous effects of the above (1) to (4) can be obtained similarly to the first embodiment.

Third Embodiment

Next, a third embodiment of the recording apparatus 11 will be described. The recording apparatus 11 according to the third embodiment is different from the second embodiment in the configuration of the support section 60 that supports the paper sheet P, and the same as the second embodiment in the remaining configuration. Accordingly, the description of the same configuration is omitted.

Figure 8:
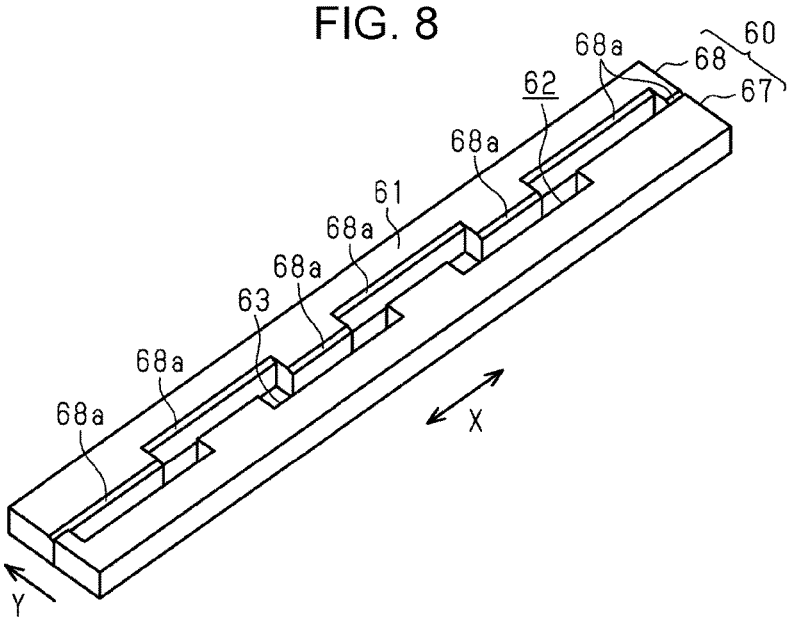
FIG. 8 is a perspective view of a support section of a recording apparatus according to a third embodiment.
Figure 9:
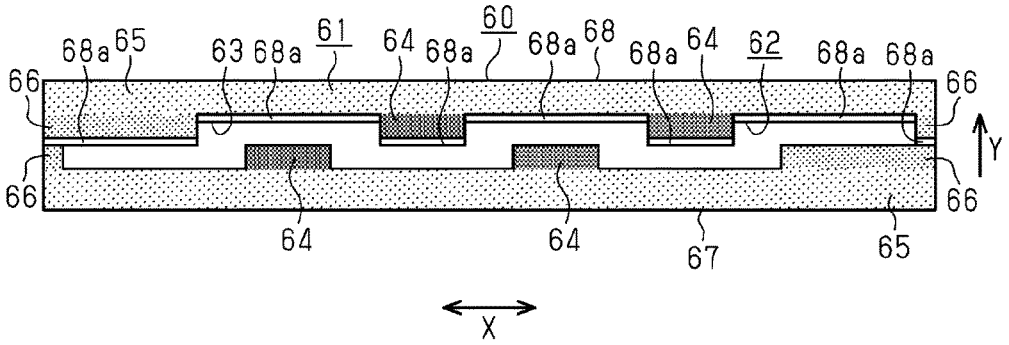
FIG. 9 is a plan view of the support section according to the third embodiment.

As shown in FIGS. 8 and 9, the support section 60 according to the third embodiment includes a chamfer 68*a* which is formed by chamfering an edge on the top of the downstream side support section 68 on the upstream side in the transfer direction Y. The chamfer 68*a* is disposed on the downstream side support section 68 so as to extend in the width direction X and is upwardly inclined from the upstream side to the downstream side in the transfer direction Y. That is, the chamfer 68*a* reduces a risk that the leading edge of the transported paper sheet P is caught by an edge of the downstream side support section 68 when the paper sheet P is transported in the transfer direction Y from the upstream side support section 67 to the downstream side support section 68.

According to the third embodiment, the advantageous effects of the above (1) to (4) can be obtained similarly to the second embodiment.

Fourth Embodiment

Next, a fourth embodiment of the recording apparatus 11 will be described. The recording apparatus 11 according to the fourth embodiment is different from the second embodiment in the configuration of the support section 60 that supports the paper sheet P, and the same as the second embodiment in the remaining configuration. Accordingly, the description of the same configuration is omitted.

Figure 10:
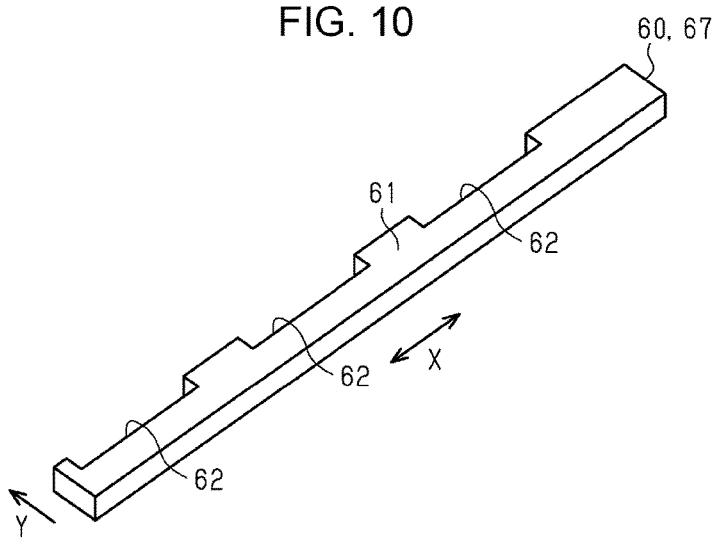
FIG. 10 is a perspective view of a support section of a recording apparatus according to a fourth embodiment.
Figure 11:
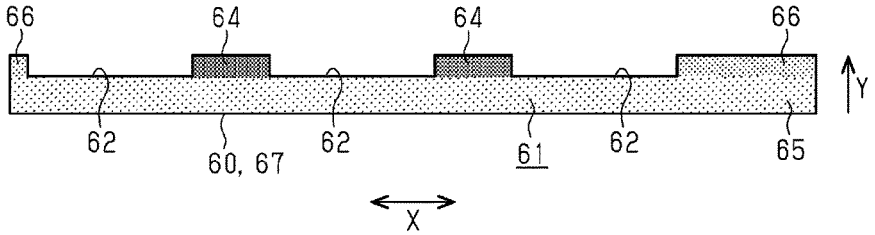
FIG. 11 is a plan view of the support section according to the fourth embodiment.

As shown in FIGS. 10 and 11, the support section 60 according to the fourth embodiment is formed solely by the upstream side support section 67. That is, the discarding section 62 is formed with a portion of the support section 60 (a portion which corresponds to the downstream side support section 68 of the second embodiment) notched.

According to the fourth embodiment, the advantageous effects of the above (1) and (2) can be obtained.

Fifth Embodiment

Next, a fifth embodiment of the recording apparatus 11 will be described. The recording apparatus 11 according to the fifth embodiment is different from the first embodiment in the configuration of the support section 60 that supports the paper sheet P and the recording head 40 that performs recording on the paper sheet P, and the same as the first embodiment in the remaining configuration. Accordingly, the description of the same configuration is omitted.

Figure 12:
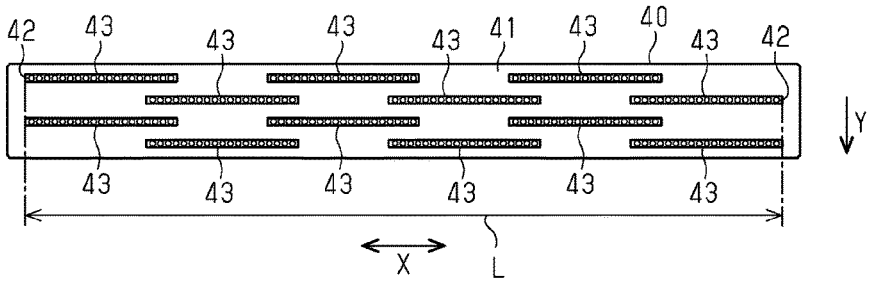
FIG. 12 is a bottom view of a support section of a recording apparatus according to a fifth embodiment.

As shown in FIG. 12, the recording head 40 according to the fifth embodiment has four rows of the plurality of nozzle rows 43 arranged in the transfer direction Y on the ejection surface 41. The nozzle rows 43 are arranged in a zig zag pattern extending in the width direction X with a predetermined space interposed in the width direction X.

Figure 13:
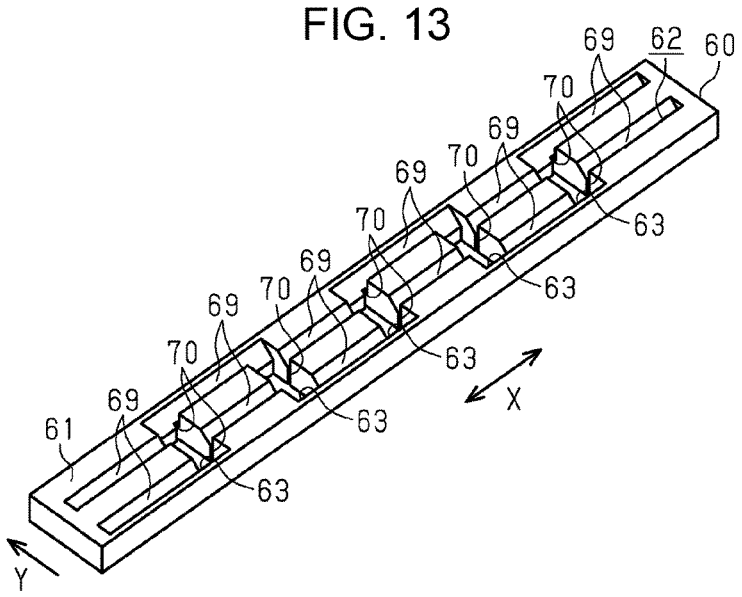
FIG. 13 is a perspective view of the support section according to the fifth embodiment.
Figure 14:
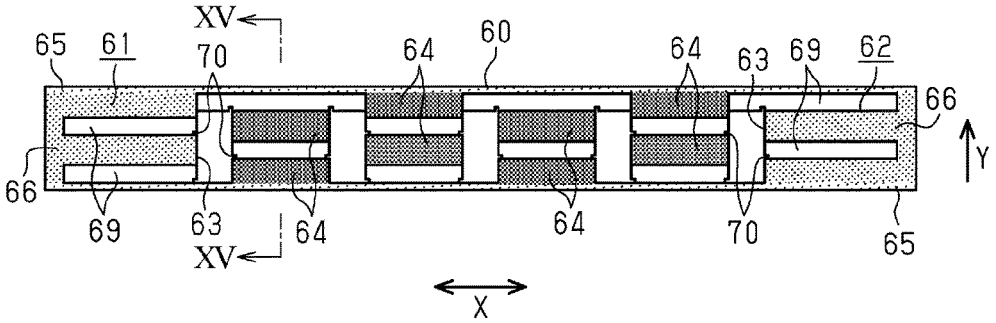
FIG. 14 is a plan view of the support section according to the fifth embodiment.
Figure 15:
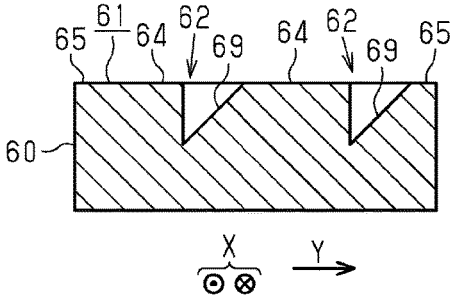
FIG. 15 is a cross sectional view taken along the arrow XV-XV of FIG. 14.

As shown in FIGS. 13, 14 and 15, the support section 60 which faces the recording head 40 is provided with the discarding section 62 at a position which faces the nozzle rows 43 and the support surface 61 at a position which does not face the nozzle rows 43. The discarding section 62, which allows ink to pass therethrough, includes the through holes 63 that vertically penetrate the support section 60, and the inclined surfaces 69 which are upwardly inclined from the upstream side to the downstream side in the transfer direction Y. That is, the inclined surfaces 69 are configured to support the end of the paper sheet P which falls into the discarding section 62.

Further, a plurality of recesses 70 is formed in a portion of the inclined surfaces 69 at positions adjacent to the through holes 63 so as to vertically extend in the same manner as the through holes 63. That is, when ink is ejected from the recording head 40 by flushing, ink ejected onto the inclined surfaces 69 flows into the through holes 63 or the recesses 70 along the inclined surfaces 69, passes through the through holes 63 or the recesses 70 and is stored in the container 50. The inclined surface 69 is preferably highly water repellent since it may be in contact with the end of the paper sheet P.

According to the fifth embodiment, the following advantageous effects can be obtained in addition to the advantageous effects of the above (1) to (4).

(5) A risk that the end of the paper sheet P transported on the support section 60 is caught by the discarding section 62 can be reduced.

Sixth Embodiment

Next, a sixth embodiment of the recording apparatus 11 will be described. The recording apparatus 11 according to the sixth embodiment is different from the fifth embodiment in the configuration of the support section 60 that supports the paper sheet P, and the same as the fifth embodiment in the remaining configuration. Accordingly, the description of the same configuration is omitted.

Figure 16:
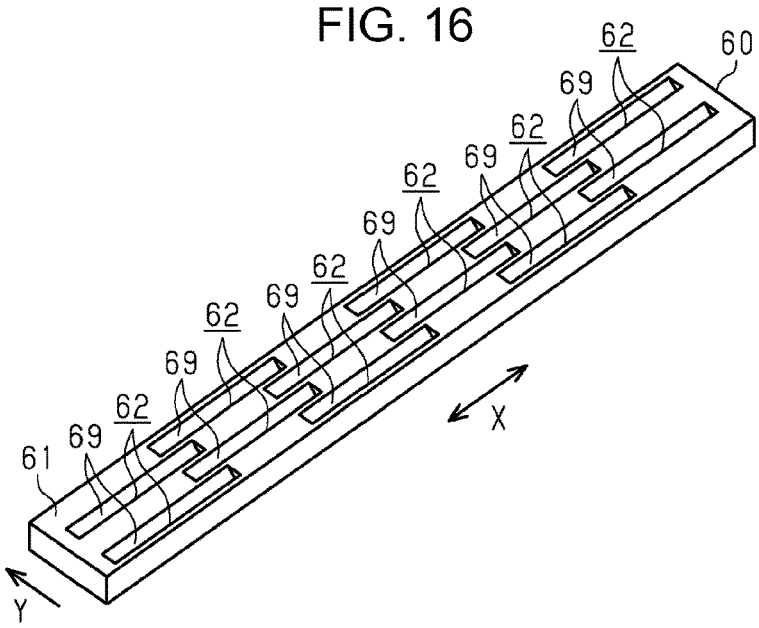
FIG. 16 is a perspective view of a support section of a recording apparatus according to a sixth embodiment.
Figure 17:
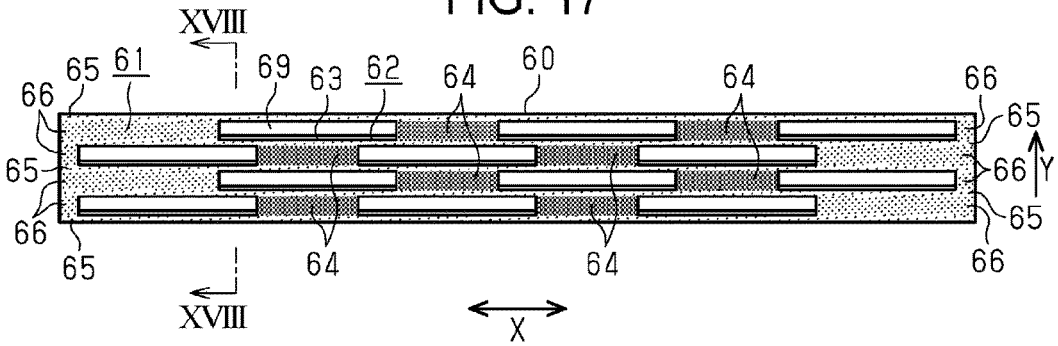
FIG. 17 is a plan view of the support section according to the sixth embodiment.
Figure 18:
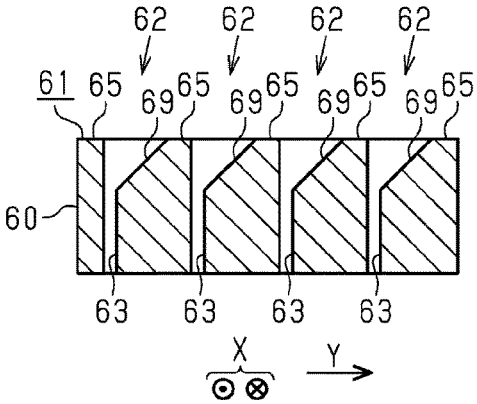
FIG. 18 is a cross sectional view taken along the arrow XVIII-XVIII of FIG. 17.

As shown in FIGS. 16, 17 and 18, the support section 60 according to the sixth embodiment is provided with the independent discarding sections 62 at positions which face the nozzle rows 43 of the recording head 40. That is, the same amount of the discarding sections 62 as the amount of the nozzle rows 43 of the recording head 40 are disposed on the support section 60. The respective discarding sections 62 include the through holes 63 that vertically penetrate the support section 60, and the inclined surfaces 69 which are upwardly inclined from the upstream side to the downstream side in the transfer direction Y. In each discarding section 62, the through hole 63 is disposed on the upstream side in the transfer direction Y, and the inclined surface 69 is disposed on the downstream side in the transfer direction Y. That is, ink ejected from the recording head 40 into the discarding section 62 flows into the through holes 63 along the inclined surfaces 69, passes through the through holes 63 and is stored in the container 50.

Moreover, on the support surface 61 that supports the paper sheet P, the second support surfaces 65, which are elongated in the width direction X, are disposed not only in the upstream and downstream regions in the transfer direction Y with respect to the region that faces the nozzle rows 43, but also in the regions which face the gaps between the nozzle rows 43 in the transfer direction Y. Each of the second support surfaces 65 are connected to each other via the third support surfaces 66 in the regions on both ends in the width direction X. Further, the second support surfaces 65 are connected to each other in the transfer direction Y via the first support surfaces 64 in the regions inside the both ends in the width direction X.

According to the sixth embodiment, the following advantageous effects can be obtained in addition to the advantageous effects of the above (1) to (5).

(6) Flatness of the paper sheet P supported by the support section 60 can be more reliably achieved since the second support surfaces 65 disposed on the support surface 61 in the upstream and downstream regions in the transfer direction Y are connected to each other in the regions inside the both ends in the width direction X.

Seventh Embodiment

Next, a seventh embodiment of the recording apparatus 11 will be described. The recording apparatus 11 according to the seventh embodiment is different from the first embodiment in the configuration of the support section 60 that supports the paper sheet P and the recording head 40 that performs recording on the paper sheet P, and the same as the first embodiment in the remaining configuration. Accordingly, the description of the same configuration is omitted.

Figure 19:
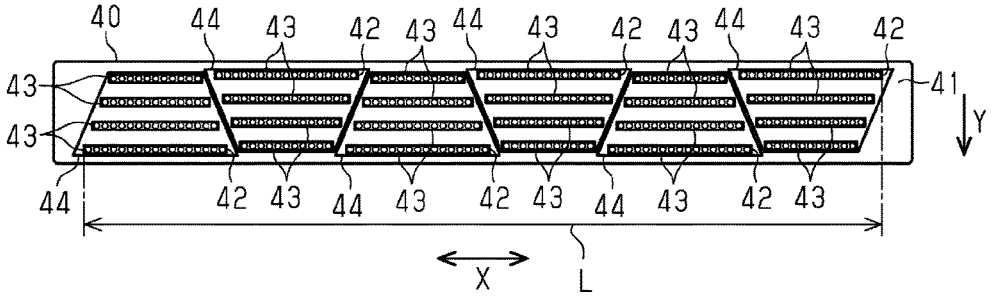
FIG. 19 is a bottom view of a recording head of a recording apparatus according to a seventh embodiment.

As shown in FIG. 19, the recording head 40 according to the seventh embodiment is provided with a plurality of nozzle groups 44 disposed on the ejection surface 41. The nozzle group 44 is composed of the plurality of nozzle rows 43 which extends in the width direction X. Each nozzle group 44 is composed of four nozzle rows 43 arranged in the transfer direction Y. The nozzle rows 43 which constitute a single nozzle group 44 have different lengths in the width direction X and form a single nozzle group 44 in a trapezoidal shape. The nozzle groups 44 having a trapezoidal shape are arranged on the ejection surface 41 with alternate orientations in the width direction X.

Figure 20:
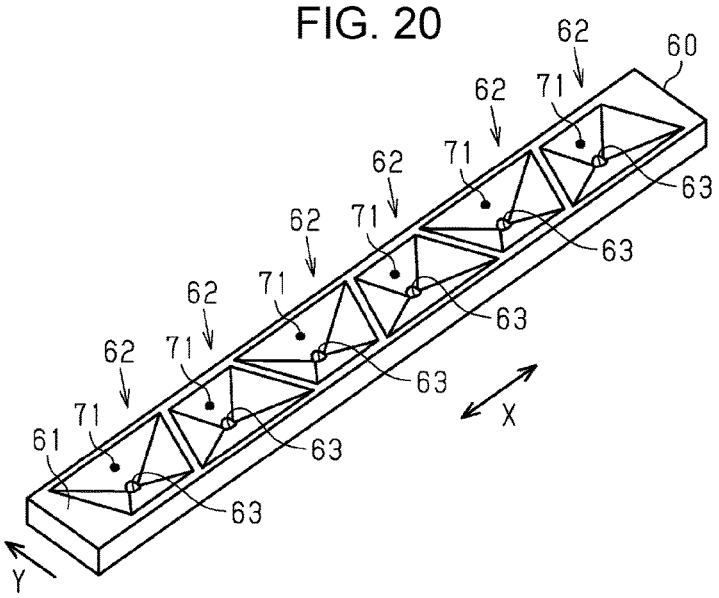
FIG. 20 is a perspective view of the support section according to the seventh embodiment.
Figure 21:
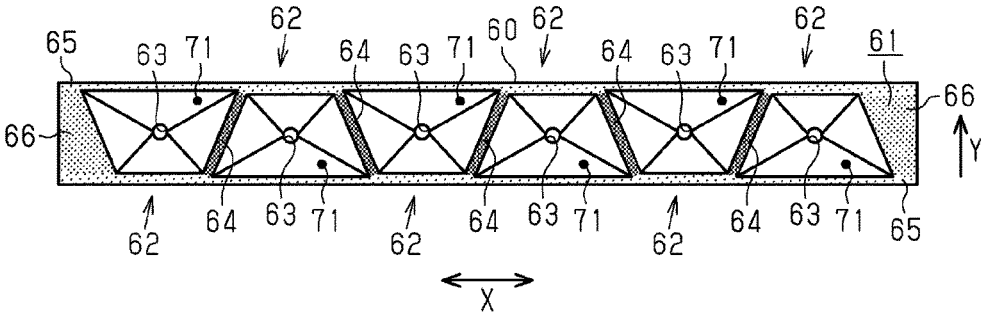
FIG. 21 is a plan view of the support section according to the seventh embodiment.

As shown in FIGS. 20 and 21, the support section 60 that faces the recording head 40 includes the independent discarding sections 62 at positions which face the nozzle groups 44 composed of the nozzle rows 43. That is, the same amount of the discarding sections 62 as the amount of the nozzle groups 44 of the recording head 40 are disposed on the support section 60. The discarding section 62 includes openings 71 which are open to the top of the support section 60, and the through holes 63 which vertically penetrate the support section 60 from the openings 71. The opening 71 is open in a trapezoidal shape which corresponds to the shape of the nozzle group 44. The discarding section 62 has a funnel shape formed by the opening 71 and the through hole 63. That is, ink ejected from the recording head 40 into the discarding section 62 flows into the through holes 63 along an inner peripheral surface of the opening 71, passes through the through holes 63 and is stored in the container 50.

Moreover, on the support surface 61 that supports the paper sheet P, the first support surfaces 64 are disposed in the regions which face gaps between the nozzle groups 44 adjacent in the width direction X. That is, the first support surfaces 64 are disposed in the regions which face gaps between the nozzle rows 43 adjacent in the width direction X. Further, the second support surfaces 65 which extend in regions longer than the regions of the first support surfaces 64 in the width direction X are disposed in the upstream and downstream regions in the transfer direction Y with respect to the region that faces the nozzle groups 44. The second support surfaces 65 are connected to each other via the third support surfaces 66 in regions on both ends in the width direction X, and via the first support surfaces 64 in regions inside the both ends in the width direction X.

According to the seventh embodiment, the advantageous effects of the above (1) to (6) can be obtained.

Eighth Embodiment

Next, an eighth embodiment of the recording apparatus 11 will be described. The recording apparatus 11 according to the eighth embodiment is different from the seventh embodiment in the configuration of the support section 60 that supports the paper sheet P and the recording head 40 that performs recording on the paper sheet P, and the same as the seventh embodiment in the remaining configuration. Accordingly, the description of the same configuration is omitted.

Figure 22:
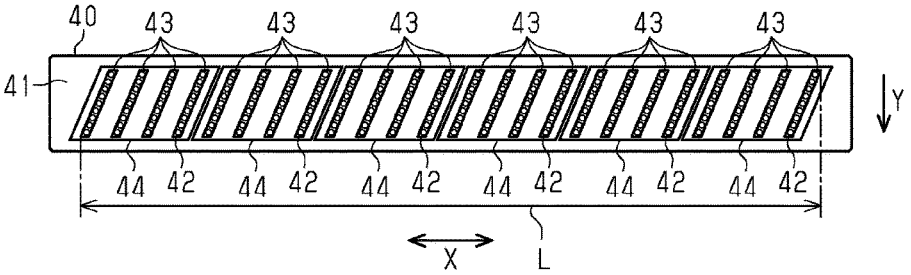
FIG. 22 is a bottom view of a recording head of a recording apparatus according to an eighth embodiment.

As shown in FIG. 22, the ejection surface 41 of the recording head 40 according to the eighth embodiment is provided with a plurality of nozzle rows 43 which extends in the width direction X and a direction that intersects with (that is, inclined to) the transfer direction Y. These nozzle rows 43 are arranged parallel to each other with a predetermined space interposed in the width direction X. Further, the nozzle groups 44 composed of the plurality of nozzle rows 43 are disposed on the ejection surface 41. Each nozzle group 44 is composed of four nozzle rows 43 arranged in the width direction X. That is, the nozzle groups 44 are arranged in the width direction X on the ejection surface 41.

Figure 23:
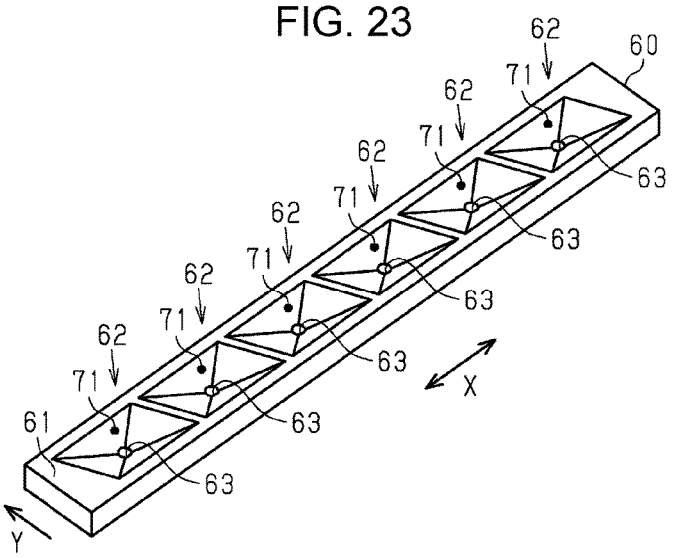
FIG. 23 is a perspective view of the support section according to the eighth embodiment.
Figure 24:
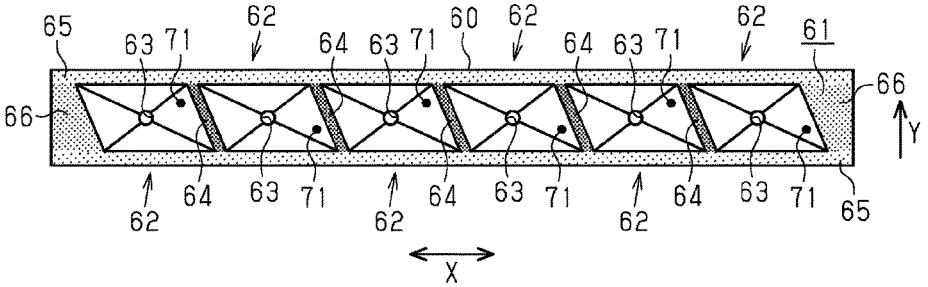
FIG. 24 is a plan view of the support section according to the eighth embodiment.

As shown in FIGS. 23 and 24, the support section 60 that faces the recording head 40 includes the independent discarding sections 62 at positions which face the nozzle groups 44 composed of the nozzle rows 43. That is, the same amount of the discarding sections 62 as the amount of the nozzle groups 44 of the recording head 40 are disposed on the support section 60. The discarding section 62 includes the openings 71 which are open to the top of the support section 60, and the through holes 63 which vertically penetrate the support section 60 from the openings 71. The opening 71 is open in a shape which corresponds to the shape of the nozzle group 44. Further, ink ejected from the recording head 40 into the discarding section 62 flows into the through holes 63 along an inner peripheral surface of the opening 71, passes through the through holes 63 and is stored in the container 50.

According to the eighth embodiment, the advantageous effects of the above (1) to (6) can be obtained similarly to the seventh embodiment. The above embodiments may be modified as described below. In addition, the following modified examples may be combined as appropriate.

In the above embodiments, the first support surface 64 and the second support surface 65 may not necessarily be a single continuous surface as the support surface 61, and may be surfaces independent from each other. In other words, the first support surface 64 and the second support surface 65 may be any surface as long as they are flush to each other. Further, a third support surface 66 may not necessarily be provided.

In the above embodiments, the discarding section 62 may not necessarily be configured to include the through hole 63. For example, a recess may be provided, and an absorber that absorbs ink may be provided in the recess. In this case, a container is not necessary.

In the above embodiments, the medium on which recording is performed by the recording apparatus 11 is not limited to the paper sheet P. For example, a cloth or a plastic film may be used.

In the above embodiments, the second support surface 65 which constitutes part of the support surface 61 may be a surface which extends in a region shorter than the length L of the nozzles 42 disposed in the width direction X.

In the above embodiments, the recording apparatus 11 may also be a fluid ejecting apparatus that performs recording by spraying or ejecting a fluid other than ink (including liquid, a liquid material which is made by dispersing or mixing a particle of a functional material in liquid, and a fluid material such as gel). For example, a liquid material ejecting apparatus that performs recording by ejecting a liquid material which includes dispersed or dissolved material such as electrode material or color material (pixel material) used for production of liquid crystal displays, EL (electroluminescence) displays and surface emission displays may also be used. Further, a fluid material ejecting apparatus that ejects gel (such as a physical gel) may be used. The present invention can be applied to any of the above fluid ejecting apparatuses. In this specification, the term "fluid" as used herein refers to a fluid except for a fluid totally made of gas, and examples of the fluid include liquid (such as inorganic solvent, organic solvent, solution, liquid resin and liquid metal (metal melt)), a liquid material and a fluid material.

What is claimed is:

1. A recording apparatus comprising:

a support section that supports a medium which is transported; and a recording head which is fixedly disposed at a position which faces the support section, and performs recording by ejecting liquid on the medium supported by the support section, wherein the recording head includes a plurality of nozzle rows which are composed of a plurality of nozzles that eject the liquid, the plurality of nozzle rows is arranged in a width direction that intersects with a transfer direction of the medium in the recording head, the support section includes a discarding section which includes a position which faces the nozzle rows of the recording head and allows the liquid ejected from the nozzle rows during flushing performed by the recording head to pass therethrough, and a support surface which is disposed at a position which does not face the nozzle rows of the recording head and is configured to support the medium, wherein the discarding section includes a continuous through hole that faces the nozzles rows, the support surface includes a first support surface which is disposed in a region which faces gaps between the nozzle rows of the recording head in the width direction, and a second support surface which extends in a region longer than a region in which the first support surface is disposed in the width direction, and the first support surface and the second support surface are formed to be flush with each other, wherein the first support surface includes projection portions that project into the discarding section, the projection portions being sized to match the size of the gaps between the nozzle rows.

2. The recording apparatus according to claim 1, wherein the second support surface is disposed on the support surface at least in an upstream region in the transfer direction with respect to a region which faces the nozzle rows.

3. The recording apparatus according to claim 2, wherein the second support surface is also disposed on the support surface in a downstream region in the transfer direction with respect to a region which faces the nozzle rows.

4. The recording apparatus according to claim 3, wherein the second support surfaces each disposed in the upstream and downstream regions in the transfer direction with respect to a region which faces the nozzle rows are connected to each other in regions on both ends in the width direction.

5. The recording apparatus according to claim 3, wherein the second support surfaces each disposed in the upstream and downstream regions in the transfer direction with respect to a region which faces the nozzle rows are connected to each other in a region which is inside both ends in the width direction and does not face the nozzle rows.

6. The recording apparatus according to claim 1, wherein the discarding section includes an inclined surface which is upwardly inclined toward a downstream side in the transfer direction.

7. The recording apparatus according to claim 1, wherein the continuous through hole is configured of a plurality of interconnected channels that surround and go around the projection portions.

8. The recording apparatus according to claim 1, wherein the continuous through hole is configured of a plurality of channels that are interconnected in a zig-zag pattern around the projection portions.

* * * * *